US007905492B2

(12) United States Patent
Doane

(10) Patent No.: US 7,905,492 B2
(45) Date of Patent: Mar. 15, 2011

(54) SELF-BOOSTING WEDGE TUBING-TO-CASING SEAL

(75) Inventor: James C. Doane, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 99 days.

(21) Appl. No.: 12/264,670

(22) Filed: Nov. 4, 2008

(65) Prior Publication Data

US 2009/0139709 A1 Jun. 4, 2009

Related U.S. Application Data

(60) Provisional application No. 60/991,936, filed on Dec. 3, 2007.

(51) Int. Cl.
*E21B 33/128* (2006.01)

(52) U.S. Cl. ..... 277/339; 166/382

(58) Field of Classification Search ..... 166/138, 166/382; 277/339, 342, 607, 626
See application file for complete search history.

(56) References Cited

U.S. PATENT DOCUMENTS

| | | | | |
|---|---|---|---|---|
| 0,823,760 | A | | 6/1906 | Callanan |
| 1,683,640 | A | | 8/1919 | Weise |
| 1,651,131 | A | | 6/1926 | Joyce |
| 2,582,700 | A | | 1/1949 | Jones |
| 2,464,713 | A | | 3/1949 | Penick |
| 2,642,141 | A | | 6/1953 | Kolb |
| 2,664,713 | A | | 1/1954 | Baker |
| 2,970,651 | A | | 2/1961 | Roberts |
| 3,015,362 | A | * | 1/1962 | Moosman ..... 166/216 |
| 3,363,695 | A | | 1/1968 | McGill |
| 3,606,348 | A | * | 9/1971 | Taylor ..... 277/328 |
| 3,750,750 | A | * | 8/1973 | Urbanosky ..... 166/187 |
| 3,897,823 | A | * | 8/1975 | Ahlstone ..... 166/120 |
| 3,976,133 | A | | 8/1976 | Allen |
| 4,138,126 | A | | 2/1979 | Jaudt |
| 4,161,319 | A | | 7/1979 | Stocking |
| 4,296,806 | A | | 10/1981 | Taylor et al. |
| 4,573,537 | A | | 3/1986 | Hirasuna et al. |
| 4,588,029 | A | | 5/1986 | Blizzard |
| 4,702,481 | A | | 10/1987 | Brammer |
| 4,732,212 | A | * | 3/1988 | Fraser, III ..... 166/216 |
| 5,333,692 | A | * | 8/1994 | Baugh et al. ..... 166/387 |
| 5,511,620 | A | | 4/1996 | Baugh et al. |

(Continued)

FOREIGN PATENT DOCUMENTS

GB 2276647 10/1994

OTHER PUBLICATIONS

"Caledyne Launches MTM Downhole Seal System". Jul. 9, 2007. Retrieved from Internet on Jun. 17, 2008.http://rigzone.com/news/article_pf.asp?a_id=47409; 1 page.

(Continued)

*Primary Examiner* — Shane Bomar
*Assistant Examiner* — Blake Michener
(74) *Attorney, Agent, or Firm* — Cantor Colburn LLP

(57) ABSTRACT

A seal and/or anchoring arrangement includes a first perimetrically closed wedge, a second perimetrically closed wedge. An actuator is in operable communication with one of the first and second wedges. A frustoconical surface is present at a radially inwardly most located surface of the first and second wedges. A and method is included.

19 Claims, 2 Drawing Sheets

U.S. PATENT DOCUMENTS

| | | | | |
|---|---|---|---|---|
| 5,775,429 | A | 7/1998 | Arizmendi et al. | |
| 5,845,945 | A * | 12/1998 | Carstensen | 285/321 |
| 5,988,276 | A | 11/1999 | Oneal | |
| 6,182,755 | B1 | 2/2001 | Mansure | |
| 6,513,600 | B2 * | 2/2003 | Ross | 166/387 |
| 6,705,615 | B2 | 3/2004 | Milberger et al. | |
| 6,896,049 | B2 | 5/2005 | Moyes | |
| 6,962,206 | B2 | 11/2005 | Hirth et al. | |
| 7,036,581 | B2 | 5/2006 | Trahan | |
| 7,134,506 | B2 | 11/2006 | Moyes | |
| 7,448,445 | B2 * | 11/2008 | Doane et al. | 166/196 |
| 2002/0014339 | A1 * | 2/2002 | Ross | 166/380 |
| 2003/0193145 | A1 | 10/2003 | Reimert et al. | |
| 2005/0242582 | A1 * | 11/2005 | Williams et al. | 285/332.1 |
| 2006/0207771 | A1 * | 9/2006 | Rios et al. | 166/382 |
| 2008/0296844 | A1 * | 12/2008 | Doane | 277/336 |

OTHER PUBLICATIONS

Problem Solving Products, Inc.; Kalrez O-Rings and Seals:; copyright 1997-2008; Retrieved from Internet Jun. 17, 2008; http://www.pspglobal.com/kalrez-o-rings/oil-gas-industries.html; 3 pages.

International Search Report and Written Opinion mailed on Sep. 2, 2008, International Search Report 5 pages, Written opinion 6 pages.

* cited by examiner

Fig. 2
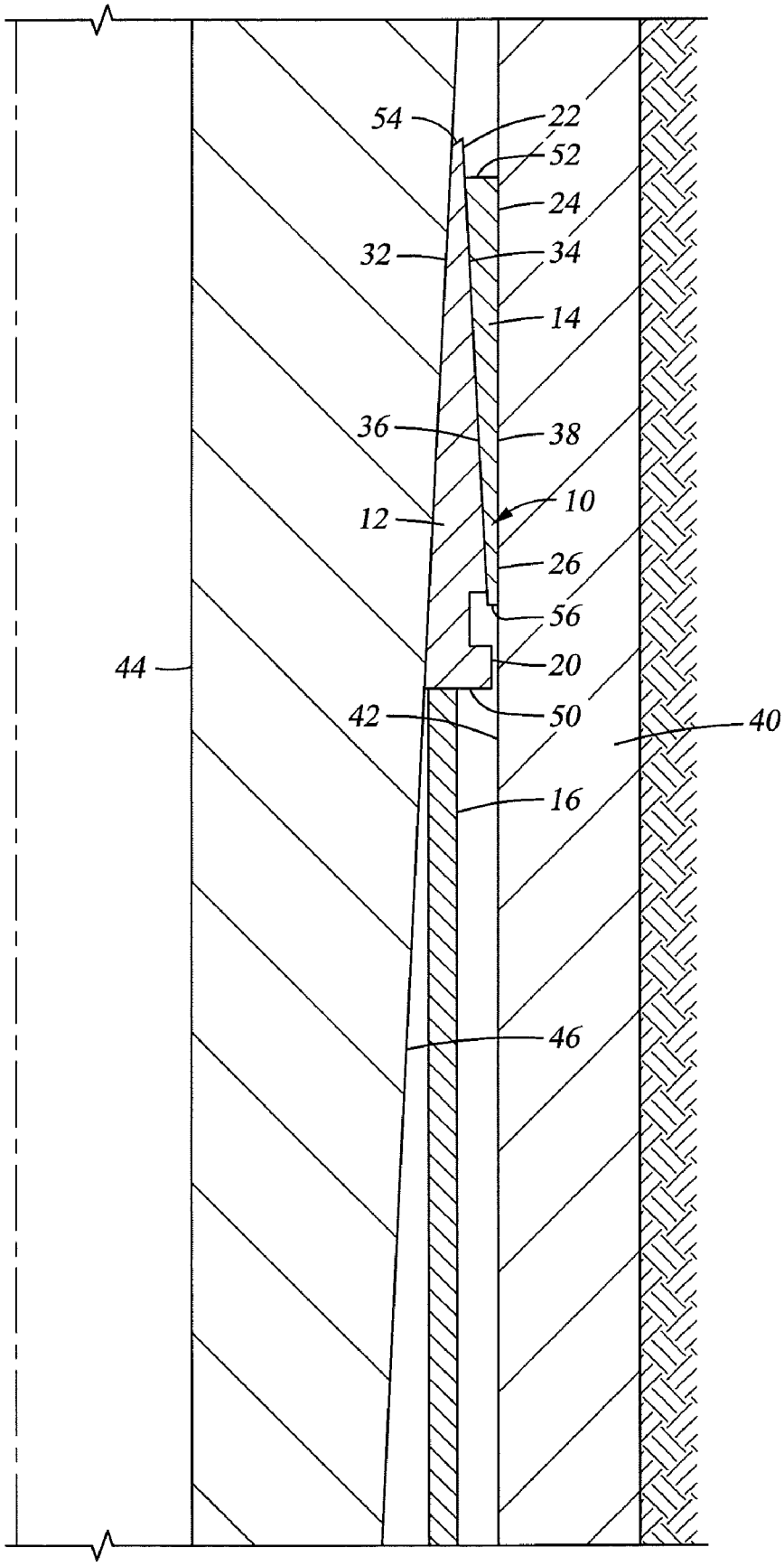
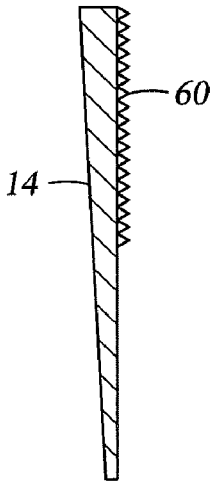
Fig. 3

SELF-BOOSTING WEDGE TUBING-TO-CASING SEAL

CROSS REFERENCE TO RELATED APPLICATION

The present application claims priority to U.S. Provisional Patent Application Ser. No. 60/991,936, filed Dec. 3, 2007, the entire contents of which are specifically incorporated herein by reference.

BACKGROUND

In the hydrocarbon recovery industry, there are many types of seals and anchoring arrangements due mostly to the many particular configurations of downhole tools that are needed for differing environmental conditions in different wells. While the great majority of prior art seals and anchoring arrangements work well for their intended purposes, there are consistently more conditions that are encountered due to advances in recovery technology as a whole and so additional sealing and anchoring arrangements are always welcomed by the art.

SUMMARY

A seal and/or anchoring arrangement includes a first perimetrically closed wedge, a second perimetrically closed wedge, an actuator in operable communication with one of the first and second wedges, and a frustoconical surface at an inside dimension of the inside more located surface of the first and second wedges. A method for creating a seal or anchor in a tubular structure includes urging at least a perimetrically closed first wedge and a perimetrically closed second wedge in a selected direction on a frustoconical surface at an inside most dimension of the at least first and second wedges, and expanding the at least first and second wedges until an outside most dimension of the at least first and second wedges contact an inside dimension of a separate structure whereby a seal of anchor is created. A seal and/or anchoring arrangement includes a first closed wedge exposed to annulus fluid, a second closed wedge exposed to annulus fluid, an actuator in operable communication with one of the first and second wedges, and a frustoconical surface at an inside dimension of the inside more located surface of the first and second wedges.

BRIEF DESCRIPTION OF THE DRAWINGS

Referring now to the drawings wherein like elements are numbered alike in the several Figures:

FIG. 2 is the view of FIG. 1 illustrated in the set position; and

FIG. 3 is a schematic cross sectional vies of a wedge with a roughened surface thereon.

DETAILED DESCRIPTION

Figure 1:
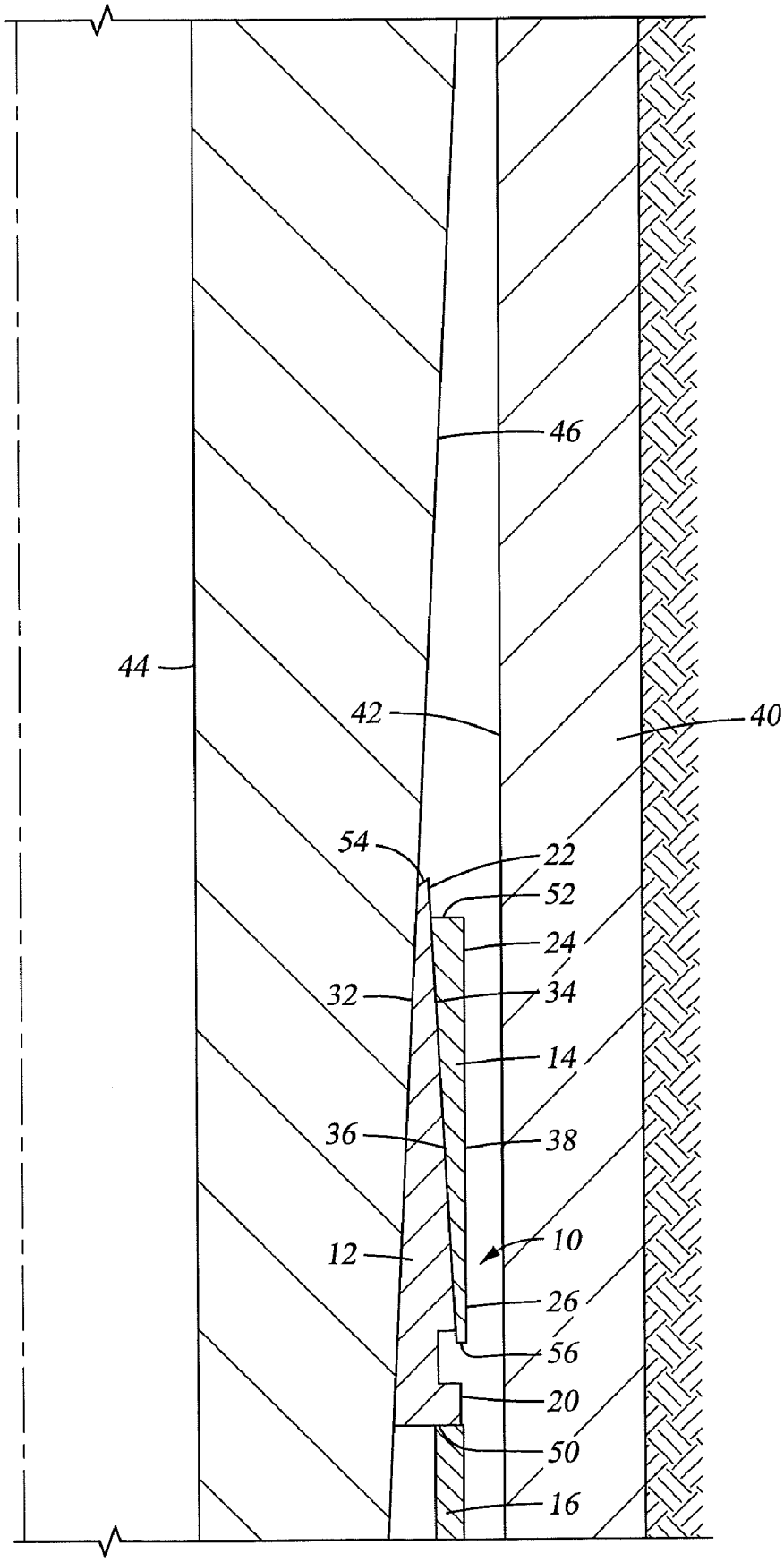
FIG. 1 is a schematic cross section view of an embodiment of a sealing and/or anchoring arrangement as disclosed herein in an unset position.

Referring to FIG. 1, a seal and or anchor (hereinafter simply referred to as "seal" for brevity) configuration 10. The seal 10 comprises three components that are interactive with each other to ultimately also interact with surfaces of separate components adjacent an inside dimension and an outside dimension of the seal 10. These components include a first wedge 12, a second wedge 14 in contact with one surface of the first wedge, and an actuator 16 in operable communication with one of the first wedge 12 and the second wedge 14. In the FIG. 1 illustration, the actuator 1 is in contact with first wedge 12 at a larger radially dimensioned end 20. It is to be appreciated that in the event that the seal 10 is to be actuated by a pushing motion from actuator 16, the actuator will be in contact with an end of one of the wedges that is of a larger radial dimension than the other end of the same wedge and the pushing direction will be the one tending to radially expand the seal 10; if alternatively the seal 10 is to be set using a pulling motion from the actuator 16, it would be in contact with an end of one of the wedges that is of a smaller radial dimension than the other end of the same wedge with the pulling direction being the one tending to radially expand the seal 10. In FIG. 1, as noted, the actuator contacts the larger radial end 20 and thus the arrangement illustrated uses a pushing motion from actuator 16. At an opposite end of first wedge 12 is a radially smaller dimensioned end 22.

Wedge 14 is complementarily positioned relative to wedge 12 with a radially larger end 24 most closely adjacent the smaller end 22 of wedge 12 while a smaller radial dimensioned end 26 of wedge 14 is most closely adjacent larger radial end 20 of wedge 12.

As will be apparent from a brief review of the drawings, each wedge includes relatively broad angular surfaces; numerals 32 and 34 are associated with these surfaces on wedge 12 while numerals 36 and 38 are associated with these surfaces on wedge 14. The angles of these surfaces are selected to ensure that when the seal 10 is set, they are substantially flush with the mating surfaces of a separate component radially outwardly located of the seal 10 and another separate component radially inwardly located of the seal 10. In one embodiment of the seal 10, the components radially outwardly and radially inwardly are as illustrated in the figures. A tubular component 40 may be a casing or other similar component having a surface 42 and the component radially inwardly of the seal is identified with numeral 44 and may be a tubular component or a solid component having a surface 46. Component 44 does require that the surface 46 at least include a frustoconical surface at a portion of the surface for interaction with and setting of the seal 10. The frustoconical surface 46 may be a part of component 44 or may be attached thereto without consequence to the operation of seal 10. For example, the component 44 may simply be a tubular that is substantially straight and a frustoconical piece could be added thereto.

In one embodiment, where the angles of surfaces 32 and 46 and surfaces 34 and 36 are substantially the same, they will appear as in FIGS. 1 and 2. The angles of these surfaces together ensure that the angle of surface 38 will substantially match the angle of the surface 42, which in the figures has no angle relative to an axis of the device (but could if desired). As in the illustrated embodiment, it is apparent that the angles of surfaces 46, 32, 34 and 36 cancel each other relative to the surface 38. This is desirable and will ensure a good seal between surface 38 and surface 42, whatever that angle may be. It will be appreciated, however, that the angles of the respective surfaces need not be exactly as shown but may be more steep or more shallow with the only result being a higher or lower setting force required from the actuator, respectively. Further, it is not critical that surface 46 be an identical angle with that of surface 32 or that surface 34 be identical to that of surface 36 or even that the angle of surface 38 be identical with that of surface 42 but rather it is merely important that these respective abutting surfaces be reasonably close to having the same angles for each interface. Ranges of angles for the respective surfaces 46, 32, 34, 36, 38 and 42 are about 0.13 to about 45 degrees with the illustrated embodiment being about 3 degrees for surfaces 46, 32, 34 and 36.

Referring now to FIGS. 1 and 2 simultaneously, actuation of the illustrated embodiment is discussed. Pursuant to a pushing motion imparted by actuator 16 upon wedge 12 in a direction associated with a growing radial dimension of component 44, wedge 12 is expanded radially outwardly. It is to be noted that both wedge 12 and wedge 14 are perimetrically closed tubular shapes and so expansion is necessary to increase their respective outside dimensions. Beneficially, this means that there are no leak paths through the wedge structures themselves. Wedge 14 expands radially outwardly along with the wedge 12 until contact is made with surface 42 of component 40. Wedge 14 does not move axially relative to wedge 12 during this expansion process although it is axially movable relative thereto. The purpose of facilitating such movement capability will be discussed hereunder.

Once the expansion of the wedges 12 and 14 causes contact between the seal 10 and the surfaces 46 and 42, load on these surfaces is increased while the actuator 16 continues to push on the wedge 12 causing some deformation of the collective surfaces to match each other thereby ensuring a fluid tight seal. In addition, due to the shape of the wedges, annulus pressure from either side of the seal acts to tighten the seal rather than defeat it. Pressure differentials work to enhance the seal by tightening the wedges 12 and 14. At the larger radial dimension of each wedge 12 and 14, a surface 50 and 52 respectively is defined that has substantially larger surface area than a surface area of surfaces 54 and 56, respectively. This arrangement provides a large surface area on only one side for each wedge for exposure to fluid pressure from the annulus thereby transmitting hydraulic force to the wedges (on one side thereof) unevenly. This biases the hydraulic pressure that might occur from each side of the seal to one wedge only, while the other wedge will be biased by pressure only from the opposite side of the seal. The surfaces 50 and 52 are intentionally exposed to the wellbore annulus so that the benefit of the arrangement is assured. This provides a great benefit to the art in that changing pressure differentials across the seal 10 will not undermine the seal 10, as they tend to do with prior art seals.

The wedges of the seal 10 may be constructed of a number of possible materials. In some embodiments, the wedges may be of the same material as each other while in others they may be of different materials. Moreover, the wedges may be made of soft metals or other materials or may be constructed of harder materials such as steel, inconel, stainless steel, etc. used alone or that is coated in some way (plated, sputtered, etc.) with softer materials. Materials contemplated include but are not limited to relatively soft materials such as soft metal like copper, gold, silver, palladium, platinum, tin, lead, bismuth, etc, or alloys of these metals that can be applied to the seal by such methods as plating, brazing, thermal spray, sputtering, etc. or elastomers, or plastic materials such as Poltetrafluoroethylene, Polyetheretherketones (PEEK), etc. that can be applied and/or bonded by various industry recognized processes. Such materials enhance the sealing operation by deforming more easily into surface imperfections as noted above.

It is further to be understood that surfaces 32, 34, 36, and 38 could have surface features such as a rib or a groove for an o-ring. Materials for such features may be any of the materials noted above.

Initially, in this detailed description, it was noted that the seal 10 could be in addition to a seal an anchor or could be alternatively an anchor. In such event where anchoring is desired and while it is possible for the seal itself with a smooth surface to provide for some anchoring, that function is enhanced by providing roughened surface features such as teeth 60 (illustrated in FIG. 3) like a slip or a knurl, or otherwise to increase the relative generated friction against mating surfaces.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A seal and/or anchoring arrangement comprising:
- a first perimetrically closed tubular wedge;
- a second perimetrically closed tubular wedge positioned radially inwardly or radially outwardly of the first wedge;
- an actuator in operable communication with one of the first and second wedges; and
- a frustoconical surface at a radially inwardly most located surface of the first and second wedges both before and after setting of the arrangement.

2. The seal and/or anchoring arrangement as claimed in claim 1 wherein the first and second wedges each comprise one end of greater radial thickness than the other end thereof.

3. The seal and/or anchoring arrangement as claimed in claim 2 wherein the wedges are arranged in the arrangement such that the end with a greater radial thickness of one is positioned closely adjacent the end with a lesser radial thickness of the other wedge.

4. The seal and/or anchoring arrangement as claimed in claim 1 wherein each wedge has angular surfaces.

5. The seal and/or anchoring arrangement as claimed in claim 4 wherein the angular surfaces are in the range of about 13 degrees to about 45 degrees.

6. The seal and/or anchoring arrangement as claimed in claim 4 wherein at least one of the angular surfaces for the first wedge has an angle of about 3 degrees.

7. The seal and/or anchoring arrangement as claimed in claim 1 wherein the wedges are composed of the same material.

8. The seal and/or anchoring arrangement as claimed in claim 1 wherein the wedges are composed of different materials.

9. The seal and/or anchoring arrangement as claimed in claim 1 wherein at least on of the wedges is composed of a soft material.

10. The seal and/or anchoring arrangement as claimed in claim 1 wherein at least one of the wedges is coated at least in part in a soft material.

11. The seal and/or anchoring arrangement as claimed in claim 10 wherein the soft material is a metal.

12. The seal and/or anchoring arrangement as claimed in claim 11 wherein the metal is one or more of copper, gold, silver, palladium, platinum, tin, lead, bismuth, and alloys of these metals.

13. The seal and/or anchoring arrangement as claimed in claim 10 wherein the soft material is a polymer.

14. The seal and/or anchoring arrangement as claimed in claim 13 wherein the polymer is one or more of an elastomer, Polytetrafluoroethylene, Polyetheretherketones (PEEK) and compounds including one or more of the foregoing.

15. The seal and/or anchoring arrangement as claimed in claim 1 wherein at least one of the wedges has a roughened surface feature.

16. A method for creating a seal or anchor in a tubular structure comprising:

urging at least a perimetrically closed tubular first wedge and a perimetrically closed tubular second wedge; positioned either radially inwardly or radially outwardly of the first wedge, in a selected direction on a frustoconical surface at an inside most dimension of the at least first and second wedges both before and after setting of the first and second wedges; and expanding the at least first and second wedges until an outside most dimension of the at least first and second wedges contact an inside dimension of a separate structure whereby a seal or anchor is created.

17. The method as claimed in claim 16 wherein the method further comprises flowing a soft material of the wedges into surface imperfections to effect the seal or anchor.

18. The method as claimed in claim 16 wherein the method further comprises exposing the at least first and second wedges to fluid pressure differentials.

19. The method as claimed in claim 16 wherein the method further comprises tightening the contact by causing pressure differentials to act on one of the at least a first wedge and a second wedge more than it does on the other of the at least first wedge and second wedge.

* * * * *